US011713164B2

(12) United States Patent
Clemence et al.

(10) Patent No.: US 11,713,164 B2
(45) Date of Patent: Aug. 1, 2023

(54) DILUTING DISPENSER ASSEMBLY

(71) Applicants: Josh Clemence, Covington, IN (US); Noah Durham, Champaign, IL (US)

(72) Inventors: Josh Clemence, Covington, IN (US); Noah Durham, Champaign, IL (US)

(73) Assignee: EnvirOx, LLC, Danville, IL (US)

( * ) Notice: Subject to any disclaimer, the term of this patent is extended or adjusted under 35 U.S.C. 154(b) by 51 days.

(21) Appl. No.: 17/512,110

(22) Filed: Oct. 27, 2021

(65) Prior Publication Data

US 2022/0048676 A1 Feb. 17, 2022

Related U.S. Application Data

(63) Continuation-in-part of application No. 17/512,016, filed on Oct. 27, 2021, now abandoned, which is a continuation of application No. 17/225,246, filed on Apr. 8, 2021, now abandoned, which is a continuation of application No. 17/004,645, filed on Aug. 27, 2020, now abandoned, which is a continuation of application No. 16/734,015, filed on Jan. 3, 2020, now abandoned, which is a continuation of application No. 16/416,120, filed on May 17, 2019, now abandoned, which is a continuation of application No. 16/141,452, filed on Sep. 25, 2018, now abandoned, which is a continuation of (Continued)

(51) Int. Cl.

| | |
|---|---|
| ***B65D 25/40*** | (2006.01) |
| ***B65D 1/02*** | (2006.01) |
| ***B65D 23/10*** | (2006.01) |
| ***B65D 1/40*** | (2006.01) |

(52) U.S. Cl.

CPC ..... *B65D 25/40* (2013.01); *B65D 1/023* (2013.01); *B65D 1/0207* (2013.01); *B65D 1/40* (2013.01); *B65D 23/10* (2013.01)

(58) Field of Classification Search

CPC ..... B65D 25/40; B65D 25/0882; B65D 25/2867; B65D 25/2826; B65D 25/2858; B65D 25/2802; B65D 23/10; B65D 1/40; B65D 1/023; B65D 1/0207; A47G 23/02

USPC ..... 222/465.1; 220/669, 771, 752; 215/40, 215/285, 396, 399; D9/528; 239/310, 239/312, 317, 318

See application file for complete search history.

(56) References Cited

U.S. PATENT DOCUMENTS

| | | | | |
|---|---|---|---|---|
| 3,134,545 | A * | 5/1964 | Armond | E03C 1/046 239/443 |
| 3,397,724 | A | 8/1968 | Bolen et al. | |
| D244,991 | S | 7/1977 | Weckman et al. | |

(Continued)

FOREIGN PATENT DOCUMENTS

| | | |
|---|---|---|
| DE | 102012216817 | 3/2014 |

OTHER PUBLICATIONS

Office Action for U.S. Appl. No. 15/425,142 dated Mar. 8, 2018.

*Primary Examiner* — Lien M Ngo
(74) *Attorney, Agent, or Firm* — King & Partners, PLC

(57) ABSTRACT

A diluting dispenser assembly, including: a housing; a water input conduit; a high-flow output conduit; a low-flow output conduit; a high-flow dispensing actuator; a low-flow dispensing actuator; a container interface, wherein the container interface is adapted to releasably engage a container disclosed herein, and wherein the container interface includes a chemical input nozzle; and a container release member.

9 Claims, 10 Drawing Sheets

Related U.S. Application Data application No. 15/425,142, filed on Feb. 6, 2017, now Pat. No. 10,081,455.

(60) Provisional application No. 62/291,573, filed on Feb. 5, 2016.

(56) References Cited

U.S. PATENT DOCUMENTS 4,125,632 A 11/1978 Vosti et al.
D259,405 S 6/1981 Drummond
D259,541 S 6/1981 Halbeisen et al.
4,318,489 A 3/1982 Snyder et al.
4,527,740 A * 7/1985 Gunzel, Jr. ..... B05B 7/2443 239/318
4,749,092 A 6/1988 Sugiura et al.
4,845,965 A 7/1989 Copeland et al.
4,865,206 A 9/1989 Behm et al.
D309,420 S 7/1990 Beaver
D311,136 S 10/1990 Barker et al.
D313,350 S 1/1991 Beaver
5,004,158 A 4/1991 Halem et al.
D329,816 S 9/1992 Beaver et al.
5,154,319 A 10/1992 Deininger et al.
D331,195 S 11/1992 Weckman
D335,454 S 5/1993 McLean et al.
D350,484 S 9/1994 Addis et al.
5,402,916 A 4/1995 Nottingham et al.
D363,667 S 10/1995 Baratta-Dragono et al.
D366,421 S 1/1996 Best
5,595,345 A * 1/1997 Chura ..... B05B 7/2443 239/312
D402,553 S 12/1998 Webster et al.
5,849,253 A 12/1998 Crossdale et al.
D409,495 S 5/1999 Hartman et al.
D420,918 S 2/2000 Hefter et al.
6,098,646 A 8/2000 Hennemann et al.
6,105,638 A 8/2000 Edwards et al.
D430,798 S 9/2000 Stevens et al.
6,116,521 A * 9/2000 Miyake ..... A01C 23/042 239/312
6,182,911 B1 * 2/2001 Hanks ..... B01F 25/105 239/340
6,464,106 B1 10/2002 Giblin
D472,151 S 3/2003 Warren et al.
6,845,886 B2 1/2005 Henry et al.
D518,731 S 4/2006 Yourist et al.
7,090,098 B2 8/2006 Livingston et al.
D529,809 S * 10/2006 Yourist ..... D9/563
D548,595 S 8/2007 Marasligiller et al.
D553,501 S 10/2007 Arnett et al.
D556,583 S 12/2007 Gurst et al.
D571,217 S 6/2008 Bates et al.
D573,884 S 7/2008 Crabtree et al.
D579,778 S 11/2008 De Gopegui et al.
D584,155 S 1/2009 Lorio
7,472,609 B1 1/2009 Larson et al.
D595,137 S 6/2009 Bates et al.
D627,231 S 11/2010 Lee et al.
D637,916 S 5/2011 McNabb et al.
D643,297 S 8/2011 Lee et al.
D651,907 S 1/2012 Dennis et al.
D661,193 S 6/2012 Merchant et al.
D683,628 S 6/2013 Claassen
D684,061 S 6/2013 Leslie et al.
D685,642 S 7/2013 Leslie et al.
D686,080 S 7/2013 Tomkins et al.
D691,477 S 10/2013 Tomkins et al.
D696,128 S 12/2013 Lindsay et al.
D705,069 S 5/2014 Crisanti et al.
D714,647 S 10/2014 Kersten
D716,146 S 10/2014 Palmatier et al.
8,919,587 B2 12/2014 Howell et al.
D721,587 S 1/2015 Bos et al.
8,961,893 B2 2/2015 Fleming et al.
D723,927 S 3/2015 Fish et al.
D724,435 S 3/2015 Kaufman et al.
D730,190 S 5/2015 Lindsay et al.
9,027,790 B2 5/2015 Caivarella et al.
D733,567 S 7/2015 Lindsay et al.
D736,637 S 8/2015 Castillo Higareda et al.
D739,247 S 9/2015 McDonnell
D739,749 S 9/2015 Bhattacharyya et al.
D741,183 S 10/2015 Cannamela et al.
D741,715 S 10/2015 Casscles et al.
D743,806 S 11/2015 Lang et al.
9,221,596 B2 12/2015 Patel
D772,714 S 11/2016 Clemence et al.
D772,715 S 11/2016 Clemence et al.
9,539,598 B2 1/2017 Caivarella et al.
9,618,376 B2 4/2017 Carbone, II et al.
D785,456 S 5/2017 Clemence et al.
D785,457 S 5/2017 Clemence et al.
D787,334 S * 5/2017 Pratt ..... D9/531
D788,587 S 6/2017 Clemence et al.
9,867,507 B2 1/2018 Toh
D821,879 S 7/2018 Clemence et al.
D821,881 S 7/2018 Clemence et al.
D822,492 S 7/2018 Clemence et al.
10,081,455 B2 9/2018 Clemence et al.
D832,105 S 10/2018 Clemence et al.
D832,108 S 10/2018 Clemence et al.
D891,929 S 8/2020 Clemence et al.
10,751,680 B2 8/2020 Carbone, II et al.
2004/0069736 A1 * 4/2004 Peronek ..... B67C 3/242 215/42
2005/0139609 A1 6/2005 Giblin et al.
2006/0101575 A1 5/2006 Louis
2007/0045222 A1 3/2007 Denner et al.
2007/0210123 A1 9/2007 Penny et al.
2012/0267381 A1 10/2012 Trude et al.
2014/0209706 A1 * 7/2014 Jia ..... B05B 7/2443 239/315
2015/0375271 A1 * 12/2015 Haworth ..... B05B 7/0062 239/318

* cited by examiner

DILUTING DISPENSER ASSEMBLY

CROSS-REFERENCE TO RELATED APPLICATIONS

This application is a continuation-in-part of U.S. application Ser. No. 17/512,016, filed Oct. 27, 2021, entitled "CONTAINER ASSEMBLY," which is a continuation of U.S. application Ser. No. 17/225,246, filed Apr. 8, 2021, entitled "CONTAINER ASSEMBLY," which is a continuation of U.S. application Ser. No. 17/004,645, filed Aug. 27, 2020, entitled "CONTAINER ASSEMBLY," which is a continuation of U.S. application Ser. No. 16/734,015, filed Jan. 3, 2020, entitled "CONTAINER ASSEMBLY," which is a continuation of U.S. application Ser. No. 16/416,120, filed May 17, 2019, entitled "CONTAINER ASSEMBLY," which is a continuation of U.S. application Ser. No. 16/141,452, filed Sep. 25, 2018, entitled "CONTAINER ASSEMBLY," which is a continuation of U.S. application Ser. No. 15/425,142, filed Feb. 6, 2017, entitled "CONTAINER ASSEMBLY," now U.S. Pat. No. 10,081,455 B2, which claims the benefit U.S. Provisional Application Ser. No. 62/291,573, filed Feb. 5, 2016, entitled "CONTAINER ASSEMBLY," which are hereby incorporated herein by reference in their entirety—including all references and appendices cited therein.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

The present invention relates in general to dispenser assemblies and, more particularly, to diluting dispenser assemblies that are uniquely adapted to releasably retain containers disclosed herein. The present invention further relates to methods for using diluting dispenser assemblies disclosed herein.

2. Background Art

Diluter/dispenser assemblies and their sub-assemblies have been known in the art for years and are the subject of a plurality of patents and publications, including: U.S. Pat. No. 10,751,680 entitled "Apparatus, Method and System for Calibrating a Liquid Dispensing System," U.S. Pat. No. 9,867,507 entitled "Dispenser," U.S. Pat. No. 9,539,598 entitled "Dispensers for Diluting a Concentrated Liquid and Dispensing the Diluted Concentrate," U.S. Pat. No. 8,961,893 entitled "Automated Chemical Diluter System Having Disposable Components," U.S. Pat. No. 7,090,098 entitled "Metering and Dispensing Closure," U.S. Pat. No. 6,105,638 "Dispensing System and Method for Dispensing a Concentrated Product and Container for use Therewith," U.S. Pat. No. 5,849,253 entitled "Dispenser," U.S. Pat. No. 5,154,319 entitled "Apparatus for the Dispensing of Liquids in Measured Amounts," U.S. Patent Application Publication No. 2006/0101575 entitled "Dispensing System and Method, and Injector Therefor," and German Patent Number DE 102012216817 entitled "Metering Device for a Fluid"—all of which are hereby incorporated herein by reference in their entirety including the references cited therein.

U.S. Pat. No. 10,751,680 appears to disclose an apparatus, method and system providing for calibration and/or control of a liquid dispensing system. The hand-held calibration auditing tool includes a flow meter with inlets adapted for quick connection to one or more liquid inputs to a liquid dispensing system. A sensor having a data output of liquid flow information for a liquid input to the dispensing system is operably connected to a controller to receive the liquid flow information for the liquid input. The controller provides a dilution rate and other liquid flow information for a liquid product input to a dispenser.

U.S. Pat. No. 9,867,507 appears to disclose a dispenser that includes a housing defining an internal volume. A cartridge is coupled with the housing. A tube extends into the internal volume of the housing. A first liquid is drawn from the internal volume into the tube through a first inlet in the tube when the pump assembly is actuated. A connecting member is positioned in the internal volume of the housing and coupled to the cartridge and the tube. A second liquid is drawn from the cartridge, through the connecting member, and into the tube through a second inlet in the tube when the pump assembly is actuated.

U.S. Pat. No. 9,539,598 appears to disclose exemplary embodiments of dispensers. One exemplary dispenser is a soap or sanitizer dispenser. The dispenser includes a housing. A removable and replaceable concentrate container for holding concentrated soap or sanitizer is located within the housing. A concentrate pump is in fluid communication with the concentrate container. A diluent container for holding a liquid is also located within the housing and a diluent pump for pumping the diluent is also included. The dispenser includes a mixing chamber in fluid communication with the concentrate pump and the diluent pump. The dispenser includes an outlet. When concentrated soap or sanitizer is pumped from the concentrate container, it mixes with diluent pumped from the diluent container to form a diluted mixture. The diluted mixture is dispensed at the outlet of the dispenser.

U.S. Pat. No. 8,961,893 appears to disclose a chemical diluter system that includes a housing. A container is mounted in the housing and is adapted for storing soluble flowable chemical solids. A mixing chamber is disposed within the housing and adjacent to the container. A disposable dispenser is attached to the container for automatically dispensing a measured amount of the chemical solids from the container into the mixing chamber via gravity flow. The mixing chamber is adapted to receive fluid for dissolution of the chemical solids and for dispensing a diluted chemical solution of the chemical solids.

U.S. Pat. No. 7,090,098 appears to disclose a metering and dispensing closure for a container wherein two rotatable disks rotate in conjunction with a stationary cap member to afford accurate measuring of a powder material and dispensing of it. The disks and the container cap afford a consistent measuring of the powder material, as well as provide a variety of drive members which can be utilized with the dispensing closure.

U.S. Pat. No. 6,105,638 appears to disclose a dispensing system and method of dispensing utilizing a container housing a concentrated product which is filled with a diluent to form a use dilution, then is subsequently installed into a dispenser having means for automatically opening the container to (give the dispenser access to the use dilution. The container includes a cap disposed thereon with a pierceable member that permits access to the interior cavity of the container when pierced. The cap is removable to permit the container to be filled with a diluent prior to installation in the dispenser.

U.S. Pat. No. 5,849,253 appears to disclose a dispenser for powdered, granular, pellet, briquette or tablet-like material. The dispenser includes a dispenser head through which the material dissolved in water can be dispensed. A spray device is provided at the head to spray water onto the material provided in the dispenser head. A suspension device is provided to suspend a bag containing the material above the dispenser head. The bag in its suspended orientation has a fastener along the bottom end which closes the bottom end of the bag. The fastener is not, however, releasable until after the bag is mounted in the dispenser. Then the fastener is releasable to allow the contents thereof to fall by gravity onto the dispenser head. The dispenser provides a system, which normally avoids contact of the toxic contents of the bag with the user. At the same time, the only waste is in the form of a bag which may be made of recyclable plastic, hence minimizing waste associated with the system.

U.S. Pat. No. 5,154,319 appears to disclose a beverage concentrate container that includes an integrally connected piston pump as a concentrate dosing unit. The container and piston pump are insertable into rigid support within a beverage dispenser cabinet for mechanical interconnection with a drive mechanism for the pump. The container and pump combination (syrup package) are fabricated from materials which are disposable.

U.S. Patent Application Publication No. 2006/0101575 appears to disclose a dispensing system and method, and injector therefor. The disclosed dispensing system, when used for washing hands, may include a faucet in communication with a water or other supply line and a soap or other substance dispensing device adapted to create, for example, a soap and water mixture in the supply line. The system may provide an injector which may include at least one vortex generator to create strong vortices that effectively commingle the two fluids into a thoroughly dispersed mixture, for discharging from the faucet outlet or other outlet.

German Patent Number DE 102012216817 appears to disclose a metering device for a fluid that is designed for use on a dispensing device for the fluid or a remote metering device for conveying the fluid. The device includes a housing, with a fluid inlet and several fluid outlets, a gearwheel which is rotatably mounted in the housing and is thus enclosed in a gearwheel chamber in the housing and which has a cavity between two adjacent teeth and the housing for fluid transport, one or more chamber inlets that are fluidly connected to the fluid inlet and the gear chamber such that fluid can flow into the gear chamber, and one or more chamber outlets that are connected to the one or more fluid outlets and the gear chamber are fluidly connected such that fluid in the cavities between the gear and the wall of the gear wheel the berm is conveyed to the chamber outlet(s) and can flow to the fluid outlet(s), which is characterized by a measuring device for non-contact optical detection of the rotational speed of the gear wheel.

While the above-identified patents and publications do appear to disclose diluter/dispenser assemblies, their configurations remain non-desirous and/or problematic inasmuch as, among other things, none of the above-identified assemblies and/or systems appear to be uniquely adapted to releasably engage containers disclosed herein.

It is therefore an object of the present invention to provide a diluting dispenser assembly that is uniquely adapted to releasably engage containers disclosed herein.

These and other objects of the present invention will become apparent in light of the present specification, claims, and drawings.

SUMMARY OF THE INVENTION

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

The present invention is directed to a diluting dispenser assembly, comprising, consisting essentially of, and/or consisting of: (a) a housing; (b) a water input conduit; (c) a high-flow output conduit; (d) a low-flow output conduit; (e) a high-flow dispensing actuator; (f) a low-flow dispensing actuator; (g) a container interface, wherein the container interface is adapted to releasably engage a container disclosed herein, and wherein the container interface includes a chemical input nozzle; and (h) a container release member.

In a preferred embodiment of the present invention, the diluting dispenser assembly further comprises a chemical selector switch.

In another preferred embodiment of the present invention, the diluting dispenser assembly further comprises a container support plate.

The present invention is further directed to a diluting dispenser assembly that is adapted to releasably engage a container, wherein the container comprises, consists essentially of, and/or consists of: (a) a front wall; (b) a first left side wall and a second left side wall having a transitional step positioned therebetween; (c) a first right side wall and a second right side wall having a transitional step positioned therebetween; (d) a back wall; (e) a first top wall wherein the first top wall includes a neck and a radial grove positioned below the neck for releasably engaging the diluting dispenser; (f) a second top wall having a handle associated therewith; and (g) a bottom wall.

The present invention is also directed to a diluting dispenser assembly that is adapted to releasably engage a container, wherein the container comprises, consists essentially of, and/or consists of: (a) a front wall, wherein the front wall comprises an upper end and a lower end; (b) a first left side wall and a second left side wall having a transitional step positioned therebetween, wherein the first and second left side walls each comprise an upper end and a lower end; (c) a first right side wall and a second right side wall having a transitional step positioned therebetween, wherein the first and second right side walls each comprise an upper end and a lower end; (d) a back wall, wherein the back wall comprises an upper end and a lower end; (e) a first top wall; (f) a neck positioned at least partially above the first top wall; (g) a radial groove positioned below the neck for releasably engaging the diluting dispenser, wherein the peripheral geometry of the radial groove is less than the peripheral geometry of the neck; (h) a spout having an aperture, wherein the spout is positioned above the neck; (i) a second top wall; (j) a handle positioned in a spaced apart relationship from the second top wall to form an aperture therebetween, wherein the aperture is adapted to contain one or more fingers of a user, and wherein the handle is angled relative to the front wall; and (k) a bottom wall.

In a preferred embodiment of the present invention, the front wall is generally planar.

In another preferred embodiment of the present invention, the transitional step positioned between the first left side wall and the second left side wall is concave.

In yet another preferred embodiment of the present invention, the second left side wall is generally planar.

In a preferred embodiment of the present invention, the transitional step positioned between the first right side wall and the second right side wall is concave.

In another preferred embodiment of the present invention, the second right side wall is generally planar.

In yet another preferred embodiment of the present invention, the back wall is generally planar.

In one aspect of the present invention, the first top wall is generally convex.

In a preferred embodiment of the present invention, the neck is octagonal.

In another preferred embodiment of the present invention, the neck comprises at least one arcuate side wall.

In yet another preferred embodiment of the present invention, the neck comprises eight arcuate side walls.

In one embodiment of the present invention, the container assembly comprises one-piece and is self-standing.

In a preferred embodiment of the present invention, the container assembly is fabricated from a thermoplastic resin.

In another preferred embodiment of the present invention, the container assembly is fabricated from at least one of an aliphatic polyamide and a semi-aromatic polyamide.

In yet another preferred embodiment of the present invention, the container assembly is fabricated from at least one of a polyethylene, a high-density polyethylene, a polycarbonate, an acrylonitrile butadiene styrene, a copolyester, a polystyrene, a high impact polystyrene, and a polyphenylene oxide.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted.

It will be further understood that the invention is not necessarily limited to the particular embodiments illustrated herein.

Figure 1:
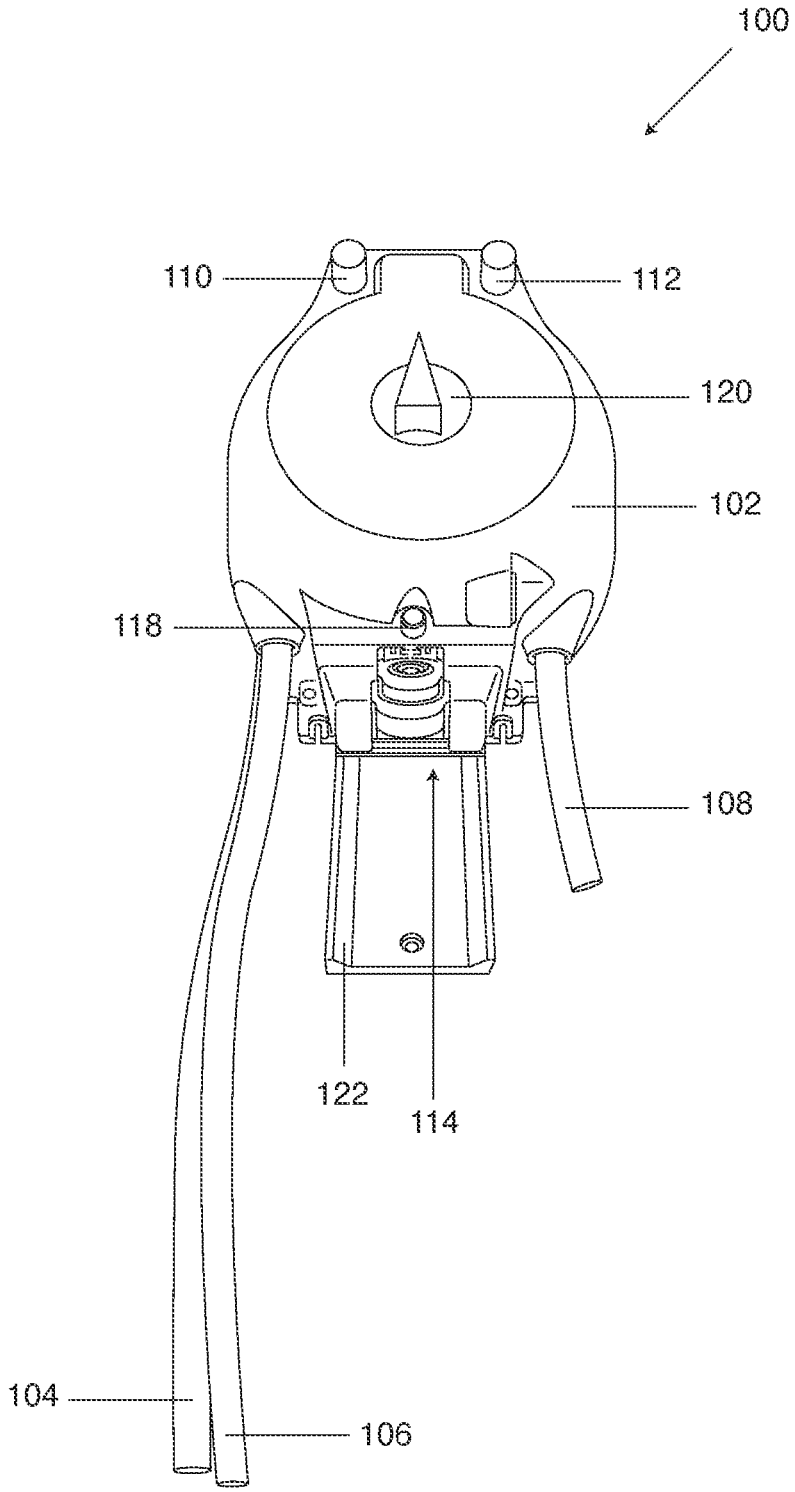
Figure 2:
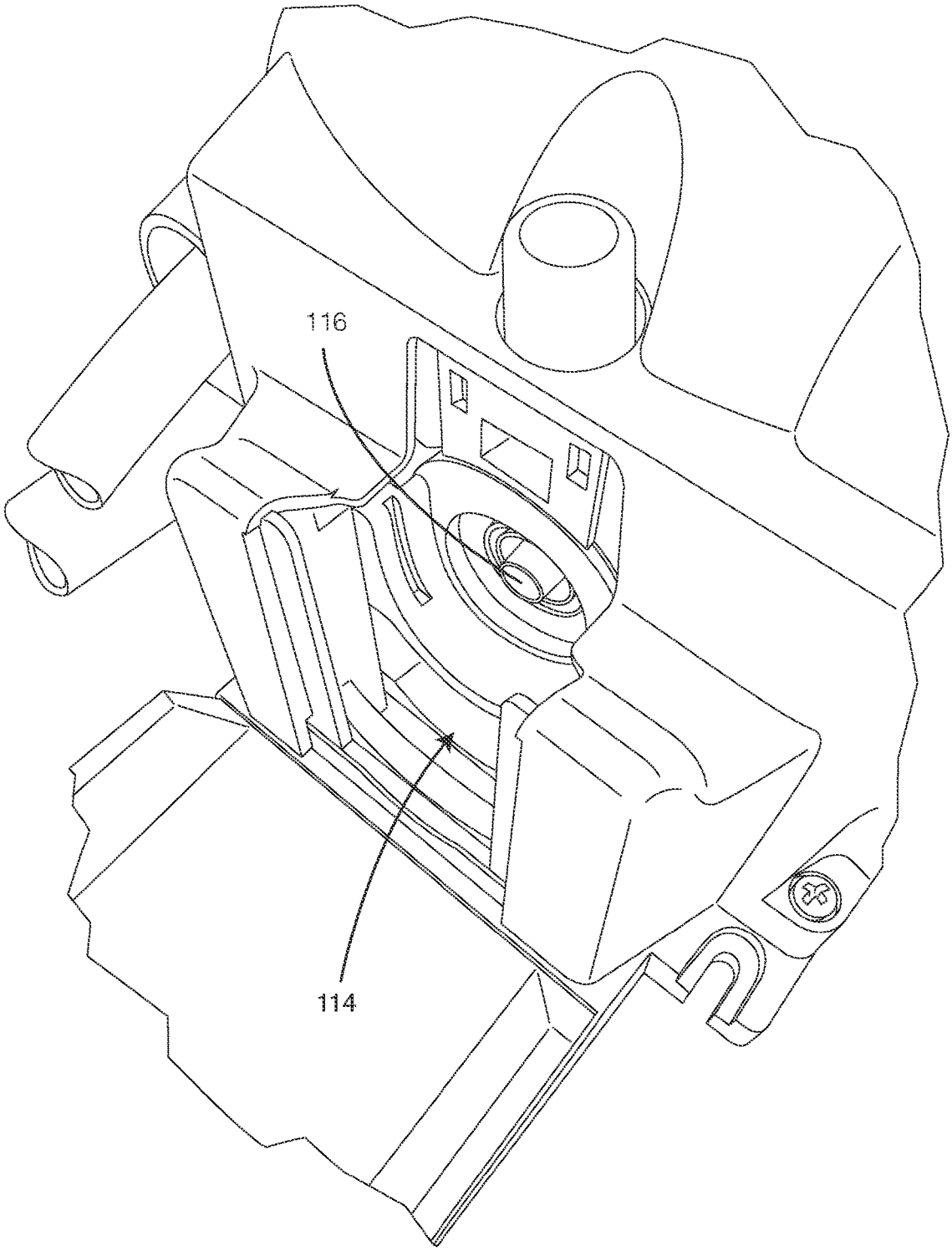
Figure 3:
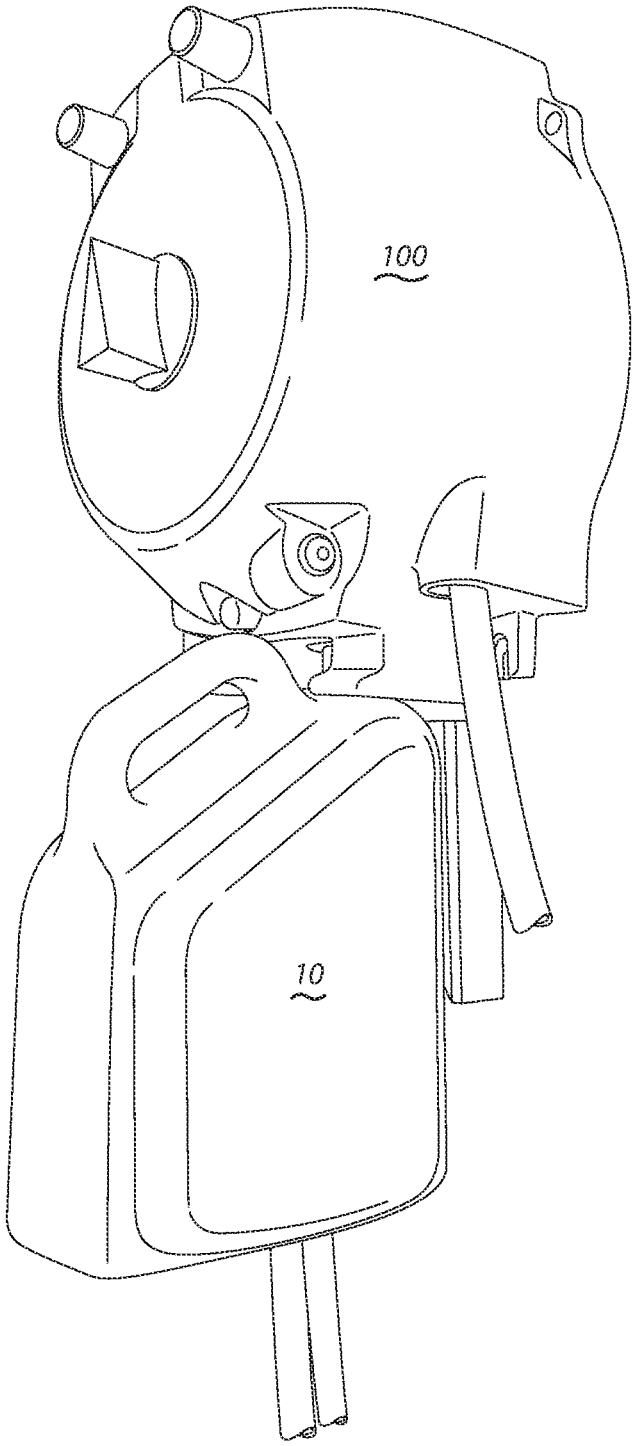
Figure 4:
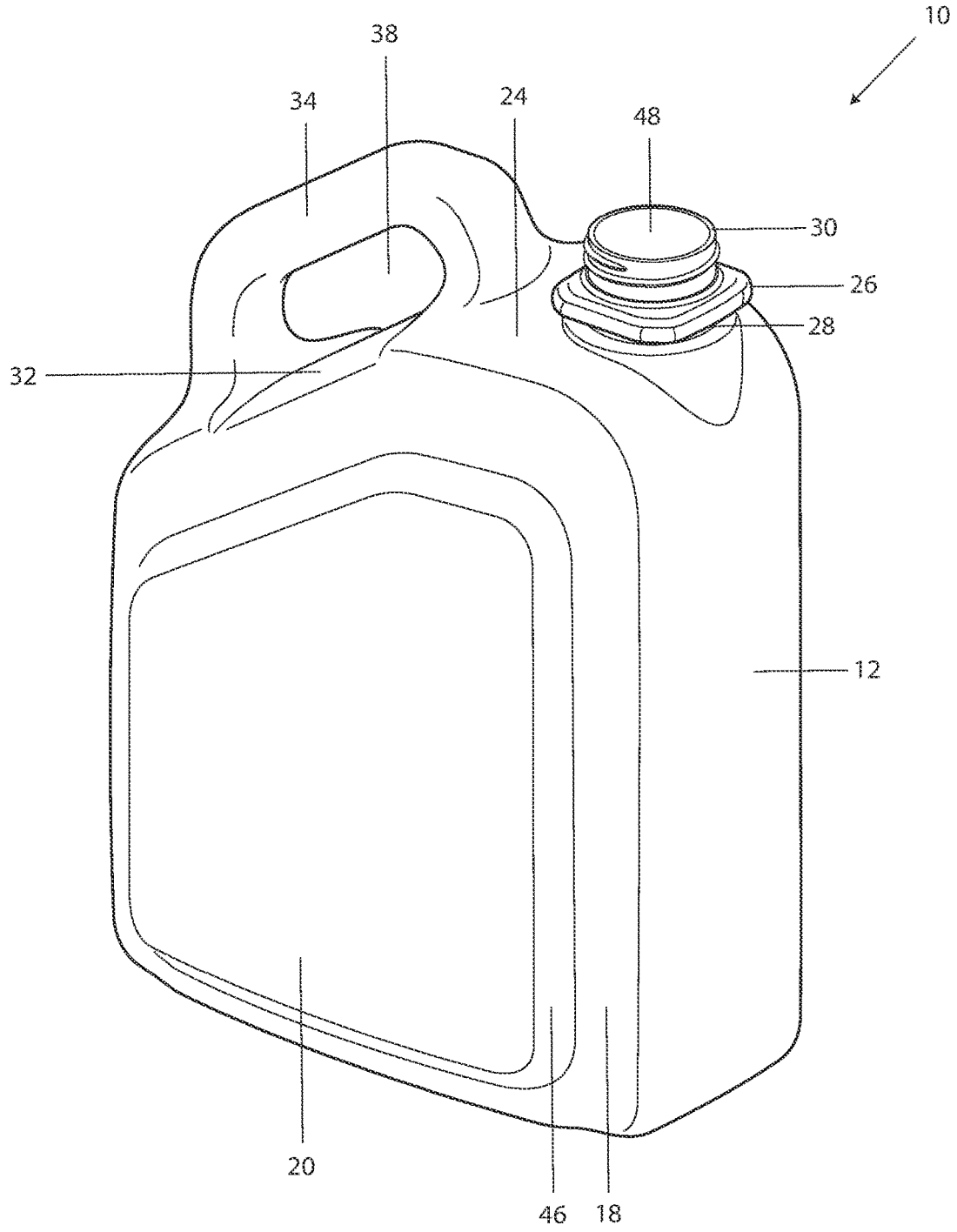
Figure 5:
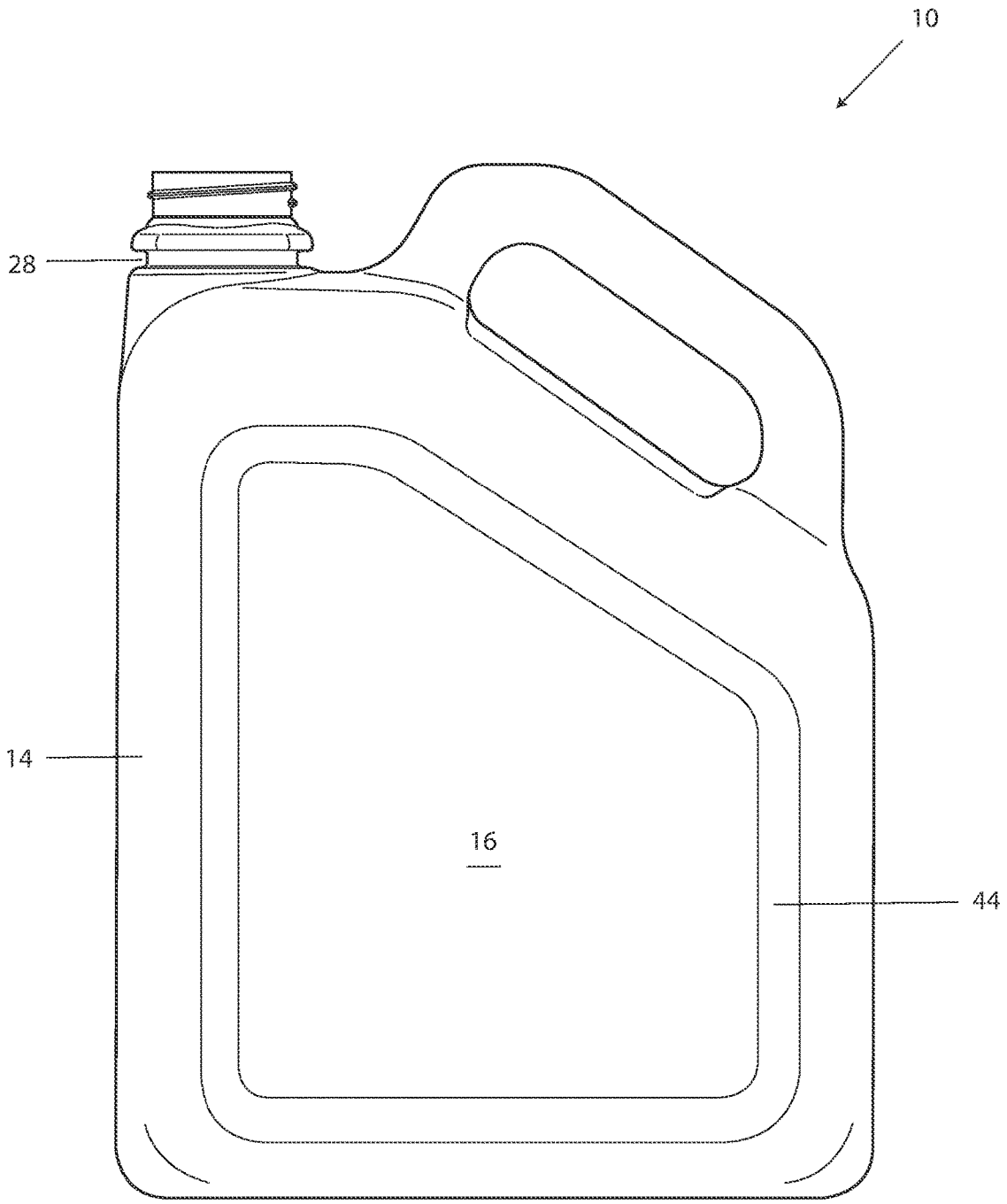
Figure 6:
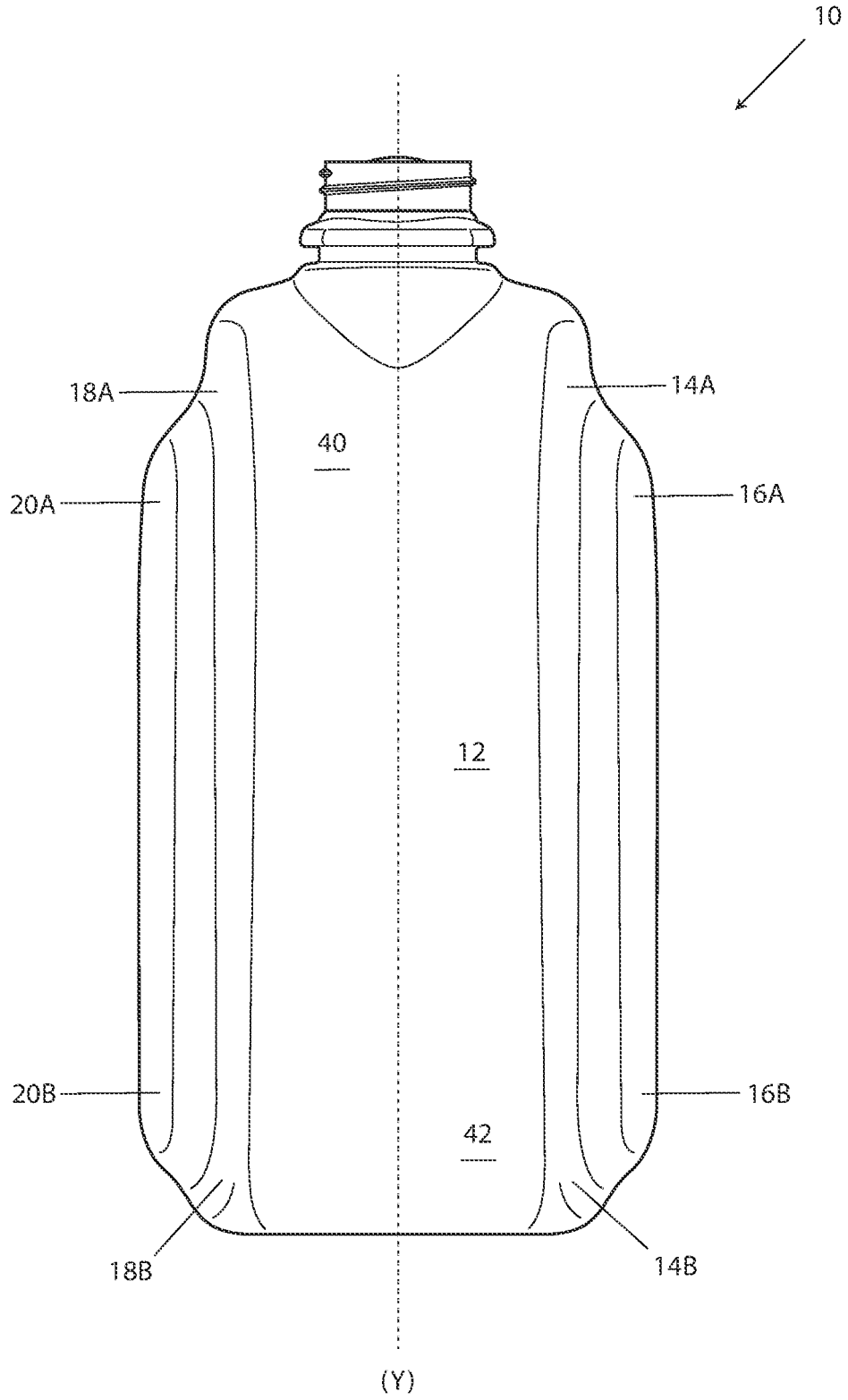
Figure 7:
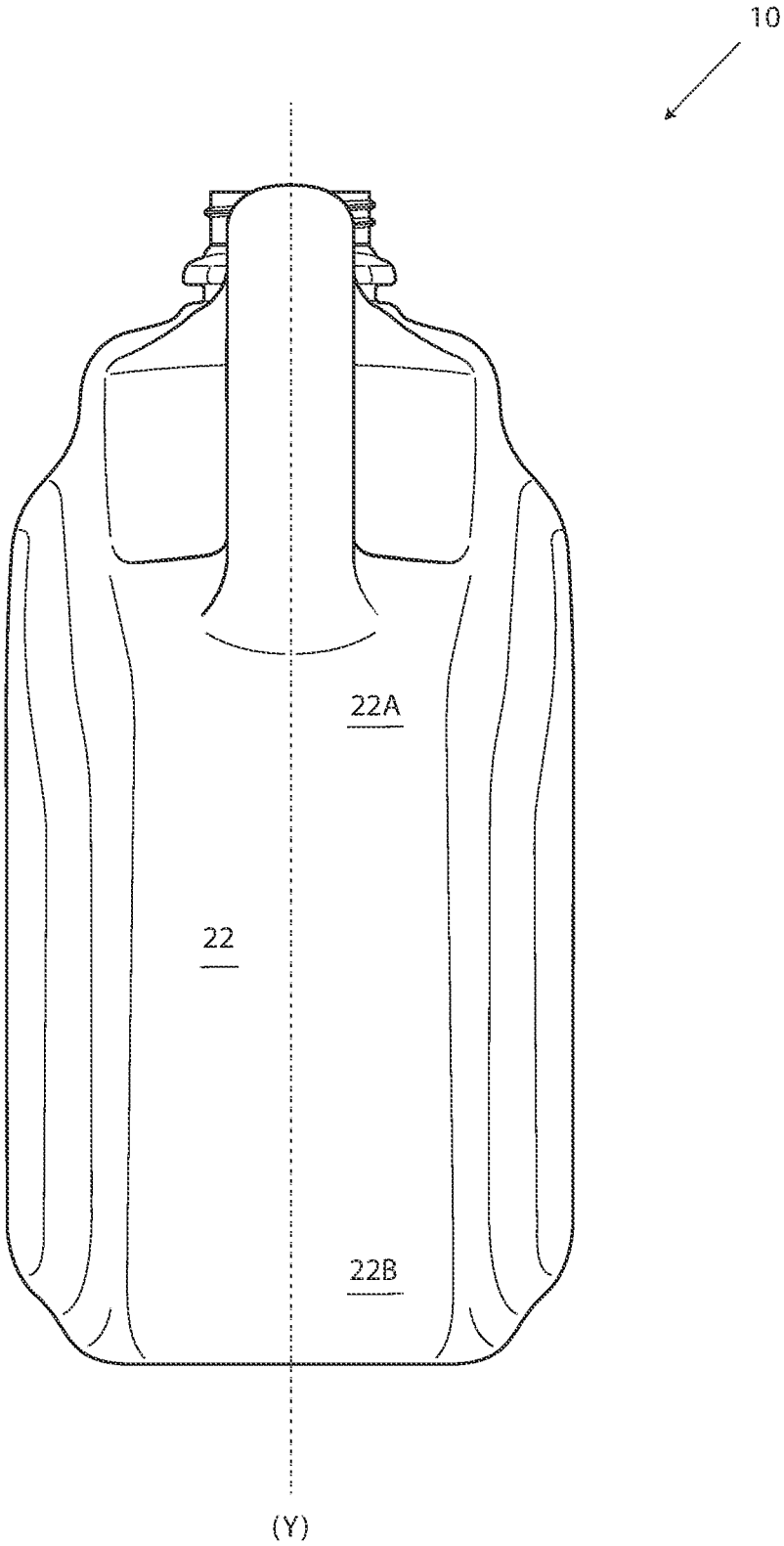
Figure 8A:
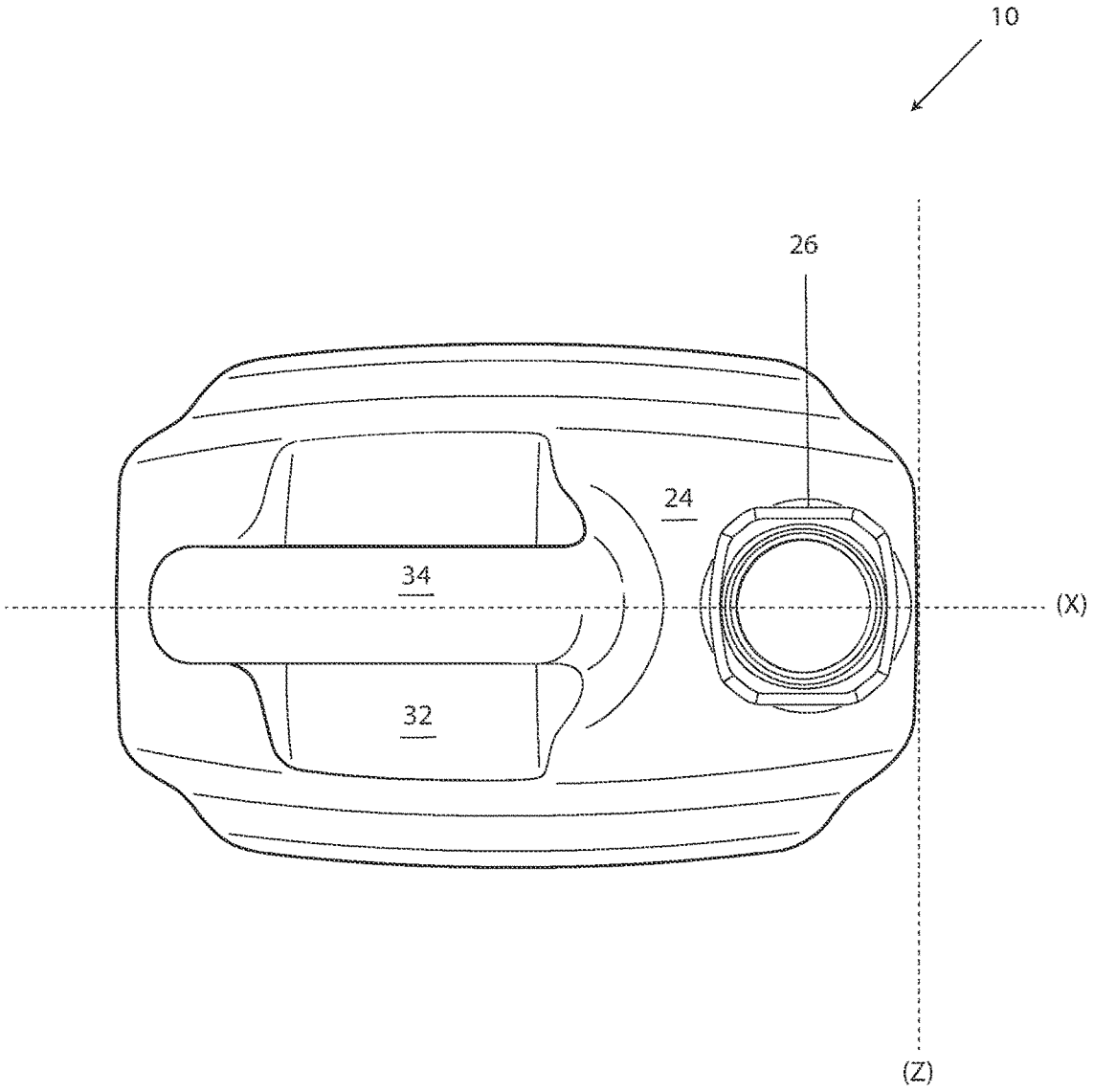
Figure 8B:
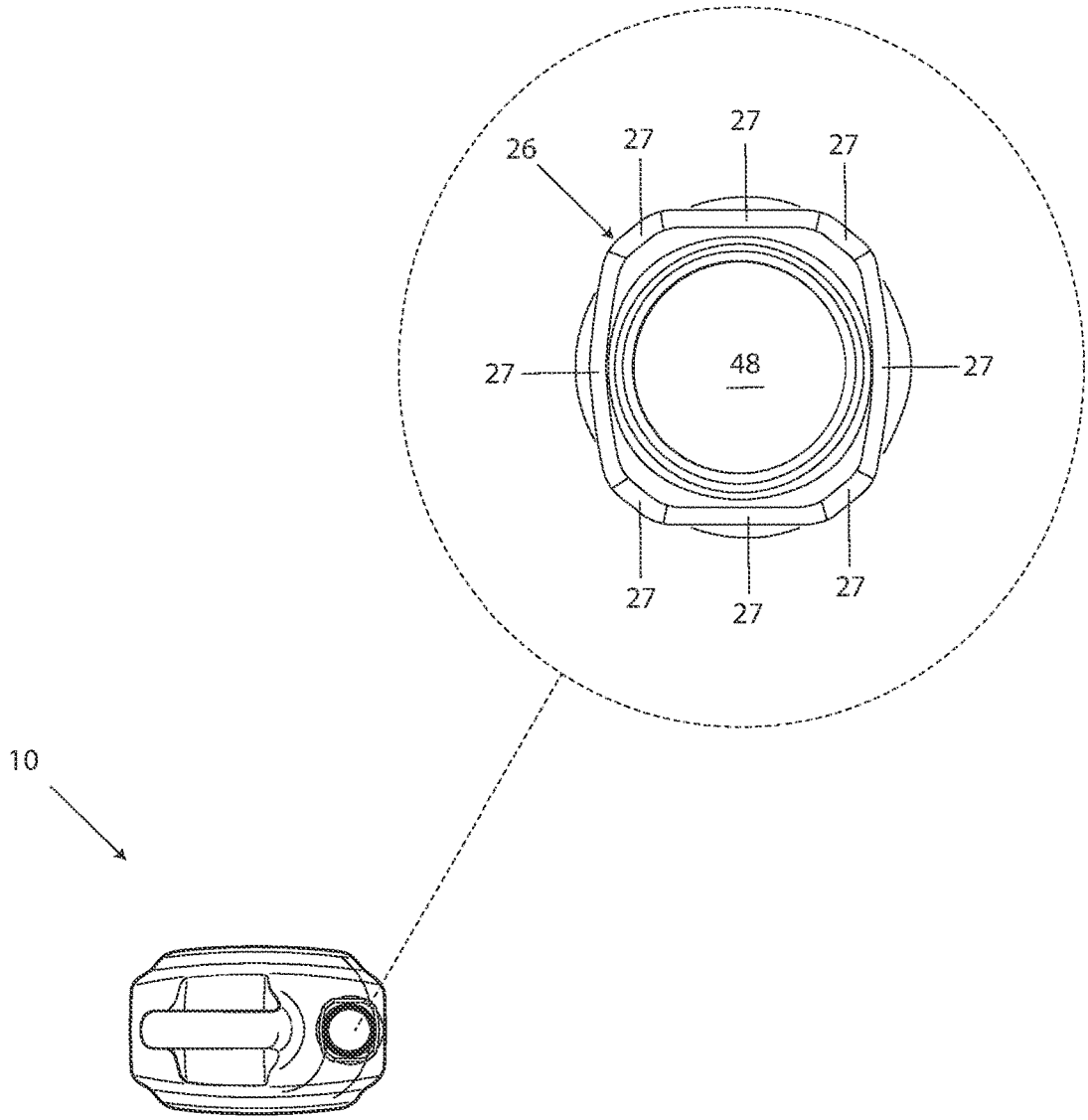
Figure 9:
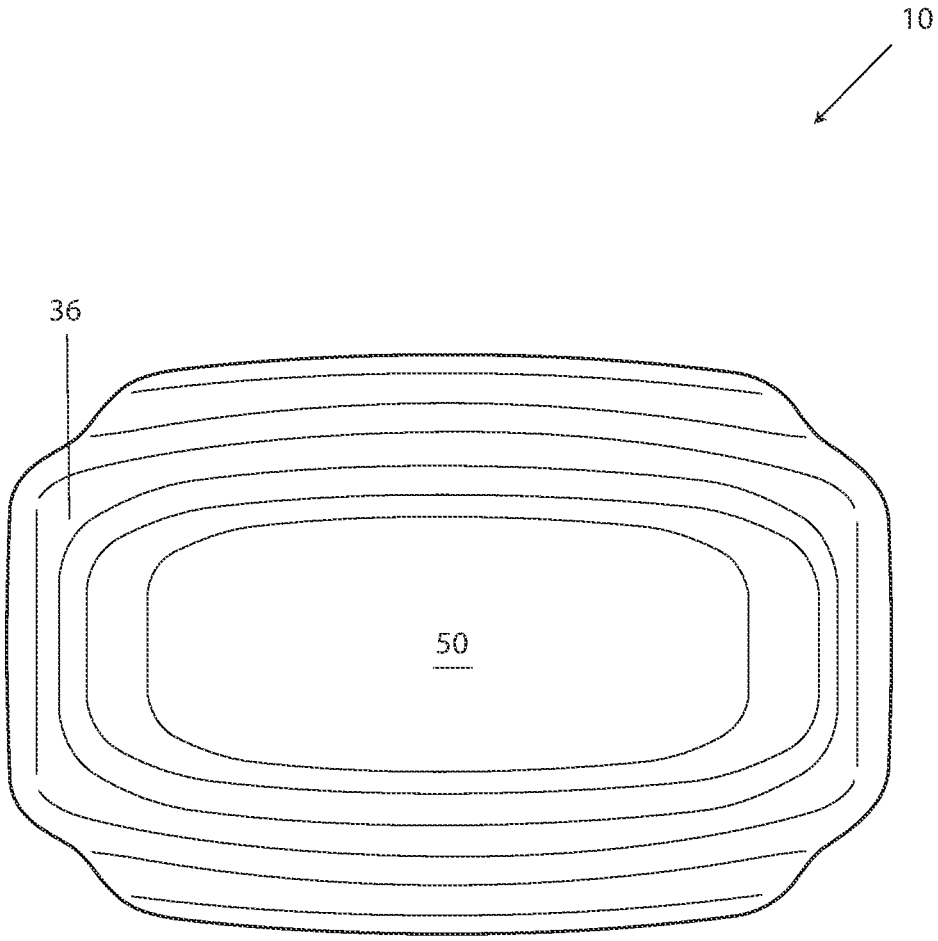

The invention will now be described with reference to the drawings wherein:

FIG. 1 is an isometric view of a diluting dispenser assembly manufactured in accordance with the present invention;

FIG. 2 is a fragmented isometric view of the diluting dispenser assembly of FIG. 1 showing the container interface;

FIG. 3 is an isometric view of the diluting dispenser assembly of FIG. 1 associated with a container;

FIG. 4 is an isometric view of a container assembly manufactured in accordance with the present invention;

FIG. 5 is a left side view of the container assembly of FIG. 4. It will be understood that a right side view is a mirror image of the left side view;

FIG. 6 is a front end view of the container assembly of FIG. 4;

FIG. 7 is a rear end view of the container assembly of FIG. 4;

FIG. 8A is a top plan view of the container assembly of FIG. 4;

FIG. 8B is a magnified top plan view of the container assembly of FIG. 4 showing details of the neck and the spout; and FIG. 9 is a bottom plan view of the container assembly of FIG. 4.

DETAILED DESCRIPTION OF THE INVENTION

While this invention is susceptible of embodiment in many different forms, there is disclosed and described herein in detail specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of one or more embodiments of the invention, and some of the components may have been distorted from their actual scale for purposes of pictorial clarity.

In accordance with the present invention, the diluting dispenser assemblies are adapted to releasably engage containers disclosed herein in a unique manner, wherein the front wall of the container is flush or substantially flush with an adjacent vertical wall and/or a vertically disposed wall of the diluting dispenser when the neck and radial groove of the container assembly are mounted/connected to the diluting dispenser.

Referring now to the drawings and collectively to FIGS. 1-3, diluting dispenser assembly 100 is shown, which generally comprises, housing 102, water input conduit 104, high-flow output conduit 106, low-flow output conduit 108, high-flow dispensing actuator 110, low-flow dispensing actuator 112, container interface 114, wherein the container interface is adapted to releasably engage container 10, chemical input nozzle 116, container release member 118, optional chemical selector switch 120, and optional container support plate 122.

In accordance with the present invention, diluting dispenser assembly 100 functions in conjunction with container 10 disclosed herein below.

Referring once again to the drawings and collectively to FIGS. 4-9, container assembly 10 is shown, which generally comprises front wall 12, first left side wall 14, second left side wall 16, first right side wall 18, second right side wall 20, back wall 22, first top wall 24, neck 26, radial groove 28, spout 30, second top wall 32, handle 34, bottom wall 36, and aperture 38. It will be understood that collectively the bottom wall, front wall, back wall, side walls, and top walls are spaced apart from one another to define a containment region for containing product (e.g., a liquid, a semi-solid, a solid) such as, but not limited to, consumable products, residential, commercial, and/or industrial cleaning products, etcetera.

Referring now to FIG. 6, front wall 12 is preferably generally planar and comprises upper end 40 and lower end 42. As is shown in FIG. 3, container assembly 10 exhibits symmetry along axis (Y) which generally corresponds to the vertical mid-point of front wall 12.

As is best shown in FIGS. 5-6 first left side wall 14 and second left side wall 16 include concave transitional step 44 positioned therebetween. The first and second left side walls comprise upper ends 14A and 16A, respectively, and lower ends 14B and 16B, respectively. In one embodiment, second left side wall 16 is generally planar.

Referring once again to FIG. 4, first right side wall 18 and second right side wall 20 include concave transitional step 46 positioned therebetween. The first and second right side walls comprise upper ends 18A and 20A, respectively, and lower ends 18B and 20B, respectively. In one embodiment, second right side wall 20 is generally planar.

As is best shown in FIG. 7, back wall 22 includes upper end 22A and lower end 22B. Back wall 22 is preferably generally planar. A first portion of handle 34 originates proximate upper end 22A of back wall 22.

Referring now to FIGS. 4 and 8A, first top wall 24 is preferably generally flat and/or generally convex. A second portion of handle 34 originates proximate a rear end of top wall 24. As is shown in FIG. 8A, container assembly 10 exhibits symmetry along axis (X) which generally corresponds to the horizontal mid-point of top wall 24 and handle 34. As is further shown in FIGS. 4 and 8A, spout 30 (as well as neck 26 and radial groove 28) are offset from axis (Z) as well as front wall 12 so that front wall 12 of container assembly 10 is flush or substantially flush with an adjacent vertical wall and/or a vertically disposed wall of the diluting dispenser when the neck and radial groove of the container assembly are mounted/connected to the diluting dispenser.

Referring once again to FIGS. 4-9 collectively, neck 26 is preferably octagonal and is positioned at least partially above first top wall 24. In one embodiment of the present invention, neck 26 includes eight arcuate side walls 27 (See FIG. 8B).

Radial groove 28 is positioned below neck 26 for releasably engaging a diluting dispenser. In one embodiment of the present invention, the peripheral geometry of the radial groove is less than the peripheral geometry of the neck.

Spout 30 is positioned above neck 26 and includes product aperture 48. During storage, spout 30 can be associated with a cap to prevent product from being contaminated and/or prevent product from spilling out of the container.

Referring now to FIGS. 4, 7, and 8A, second top wall 32 includes a generally planar surface. Second top wall 32 preferably forms an obtuse angle with back wall 22 (See FIG. 5).

Handle 34 is positioned in a spaced apart relationship from second top wall 32 to form aperture 38 therebetween. Aperture 38 is adapted to contain one or more fingers of a user. In one embodiment, handle 34 is angled relative to back wall 22 so that the user can ergonomically use and/or transport container assembly 10.

Bottom wall 36 enables container assembly 10 to be self-standing. Bottom wall 36 also preferably includes recessed region 50. It will be understood that, although not shown, bottom wall 36 and/or recessed region 50 can also include one more ground engaging feet.

In a preferred embodiment of the present invention, container assembly 10 is fabricated from a thermoplastic resin.

In another preferred embodiment of the present invention, container assembly 10 is fabricated from an aliphatic polyamide and/or a semi-aromatic polyamide.

In yet another preferred embodiment of the present invention, container assembly 10 is fabricated from one or more of a polyethylene, a high-density polyethylene, a polycarbonate, an acrylonitrile butadiene styrene, a copolyester, a polystyrene, a high impact polystyrene, and a polyphenylene oxide.

The foregoing description merely explains and illustrates the invention and the invention is not limited thereto except insofar as the appended claims are so limited, as those skilled in the art who have the disclosure before them will be able to make modifications without departing from the scope of the invention.

While certain embodiments have been illustrated and described, it should be understood that changes and modifications can be made therein in accordance with ordinary skill in the art without departing from the technology in its broader aspects as defined in the following claims.

The embodiments, illustratively described herein may suitably be practiced in the absence of any element or elements, limitation or limitations, not specifically disclosed herein. Thus, for example, the terms "comprising," "including," "containing," etcetera shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The present disclosure is not to be limited in terms of the particular embodiments described in this application. Many modifications and variations can be made without departing from its spirit and scope, as will be apparent to those skilled in the art. Functionally equivalent methods and compositions within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can of course vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etcetera. As a non-limiting example, each range discussed herein can be readily broken down into a lower third, middle third and upper third, etcetera. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims.

What is claimed and desired to be secured by Letters Patent of the United States is:

1. A diluting dispenser assembly in combination with a container, comprising:

a housing; a water input conduit; a high-flow output conduit; a low-flow output conduit; a high-flow dispensing actuator; a low-flow dispensing actuator; a container interface, wherein the container interface is adapted to releasably engage a container, and wherein the container interface includes a chemical input nozzle; and a container release member; and a container comprising: a front wall; a back wall; a left side wall; a right side wall; a bottom wall; a first top wall; a neck, wherein the neck is octagonal and positioned at least partially above the first top wall, wherein the neck includes eight arcuate side walls; a radial groove positioned below the neck, wherein the peripheral geometry of the radial groove is less than the peripheral geometry of the neck; a spout having an aperture, wherein the spout is positioned above the neck; a second top wall, wherein the second top wall forms an obtuse angle with the back wall; and a handle positioned in a spaced apart relationship from the second top wall to form an aperture therebetween, wherein the aperture is adapted to contain one or more fingers of a user, wherein the handle is angled relative to the front wall, and wherein the handle includes a top wall positioned above both the neck and the spout.

2. The diluting dispenser and container assembly according to claim 1, further comprising a chemical selector switch.

3. The diluting dispenser and container assembly according to claim 1, further comprising a container support plate.

4. A diluting dispenser assembly in combination with a container, comprising:

a housing; a water input conduit; a high-flow output conduit; a low-flow output conduit; a high-flow dispensing actuator; a low-flow dispensing actuator; a container interface, wherein the container interface is adapted to releasably engage a container, and wherein the container interface includes a chemical input nozzle; a container release member; and a container comprising: a front wall; a first left side wall and a second left side wall having a transitional step positioned therebetween; a first right side wall and a second right side wall having a transitional step positioned therebetween; a back wall; a first top wall wherein the first top wall includes a neck and a radial grove positioned below the neck for releasably engaging the diluting dispenser; a second top wall having a handle associated therewith; a bottom wall; a spout having an aperture, wherein the spout is positioned above the neck; and wherein the handle includes a top wall positioned above both the neck and the spout.

5. A diluting dispenser assembly in combination with a container, comprising:

a housing; a water input conduit; an output conduit; a container interface, wherein the container interface is adapted to releasably engage a container, and wherein the container interface includes a chemical input nozzle; and a container release member; and a container comprising: a front wall; a back wall; a left side wall; a right side wall; a bottom wall; a first top wall; a neck, wherein the neck is octagonal and positioned at least partially above the first top wall, wherein the neck includes eight arcuate side walls; a radial groove positioned below the neck, wherein the peripheral geometry of the radial groove is less than the peripheral geometry of the neck; a spout having an aperture, wherein the spout is positioned above the neck; a second top wall, wherein the second top wall forms an obtuse angle with the back wall; and a handle positioned in a spaced apart relationship from the second top wall to form an aperture therebetween, wherein the aperture is adapted to contain one or more fingers of a user, wherein the handle is angled relative to the front wall, and wherein the handle includes a top wall positioned above both the neck and the spout.

6. The diluting dispenser and container assembly according to claim 5, wherein the container assembly comprises one-piece and is self-standing.

7. The diluting dispenser and container assembly according to claim 6, wherein the container assembly is fabricated from a thermoplastic resin.

8. The diluting dispenser and container assembly according to claim 6, wherein the container assembly is fabricated from at least one of an aliphatic polyamide and a semi-aromatic polyamide.

9. The diluting dispenser and container assembly according to claim 6, wherein the container assembly is fabricated from at least one of a polyethylene, a high-density polyethylene, a polycarbonate, an acrylonitrile butadiene styrene, a copolyester, a polystyrene, a high impact polystyrene, and a polyphenylene oxide.

* * * * *